US009890771B2

(12) United States Patent
Jiang

(10) Patent No.: US 9,890,771 B2
(45) Date of Patent: Feb. 13, 2018

(54) GAS OPERATED BOOSTER PUMP

(71) Applicant: SHAANXI DINGJI ENERGY TECHNOLOGY CO., LTD., Xian—Shaanxi Province (CN)

(72) Inventor: Ze Jiang, Xian (CN)

(73) Assignee: SHAANXI DINGJI ENERGY TECHNOLOGY CO., LTD., Xian—Shaanxi Province (CN)

( * ) Notice: Subject to any disclaimer, the term of this patent is extended or adjusted under 35 U.S.C. 154(b) by 309 days.

(21) Appl. No.: 14/883,888

(22) Filed: Oct. 15, 2015

(65) Prior Publication Data

US 2016/0153445 A1 Jun. 2, 2016

(30) Foreign Application Priority Data

Nov. 28, 2014 (CN) ..... 2014 1 0711762

(51) Int. Cl.
*F04B 9/135* (2006.01)
*F04B 53/10* (2006.01)
*F04F 13/00* (2009.01)

(52) U.S. Cl.
CPC ..... *F04B 9/135* (2013.01); *F04B 53/10* (2013.01); *F04F 13/00* (2013.01)

(58) Field of Classification Search
CPC ..... F04B 53/10; F04B 9/135; F04F 13/00
USPC ..... 417/393, 399, 401, 538, 376
See application file for complete search history.

(56) References Cited

U.S. PATENT DOCUMENTS 6,937 A * 12/1849 Jeffery ..... F04B 1/02 417/538
255,222 A * 3/1882 Wang ..... F04B 43/0736 417/393
1,161,787 A * 11/1915 Nickol ..... F04B 15/023 417/317
1,565,886 A * 12/1925 Aikman ..... F04B 47/04 166/68.5
2,081,220 A * 5/1937 Coberly ..... F04B 47/04 29/DIG. 35
2,641,187 A * 6/1953 Adams ..... F04B 9/10 417/396
2,977,040 A * 3/1961 Dulebohn ..... F04B 9/135 417/225

(Continued)

*Primary Examiner* — Devon Kramer
*Assistant Examiner* — Benjamin Doyle
(74) *Attorney, Agent, or Firm* — Stephen T. Olson; Harness, Dickey & Pierce, P.L.C.

(57) ABSTRACT

Disclosed are an isentropic booster and a method thereof. The booster comprises a main body pump having a chamber provided with a fixed division plate, a left piston, a right piston and a connecting rod separating the chamber into a plurality of independent booster chambers. The connecting rod passes through the division plate and connects at its two opposite ends with the left piston and the right piston. The volume of the booster chambers is changed with the movement of the left piston and the right piston. A part of the plurality of the booster chambers connect between high-pressure gas source and a medium-pressure gas pipeline network, and the rest of the plurality of the booster chambers connect between low-pressure gas source and the medium-pressure gas pipeline network. The isentropic booster of present invention improves efficiency of using high-pressure gas.

9 Claims, 1 Drawing Sheet

(56) References Cited

U.S. PATENT DOCUMENTS 3,349,995 A * 10/1967 Sheesley ..... F04B 9/10 417/225
4,293,287 A * 10/1981 Carrens ..... F01L 17/00 417/393
4,334,833 A * 6/1982 Gozzi ..... F04B 9/115 417/243
4,354,806 A * 10/1982 McMillin ..... B01F 3/0473 417/393
4,368,008 A * 1/1983 Budzich ..... F01L 25/06 417/267
4,416,593 A * 11/1983 Cummings ..... F04B 47/12 417/344
4,436,493 A * 3/1984 Credle, Jr. ..... B67D 1/103 137/454.4
4,480,969 A * 11/1984 Credle, Jr. ..... B67D 1/103 417/393
4,512,188 A * 4/1985 Erickson ..... F04B 9/115 166/90.1
4,515,516 A * 5/1985 Perrine ..... F04B 41/00 222/3
4,540,349 A * 9/1985 Du ..... F04B 9/135 417/393
4,634,350 A * 1/1987 Credle, Jr. ..... B67D 1/103 417/393
4,682,937 A * 7/1987 Credle, Jr. ..... B67D 1/103 417/393
4,684,332 A * 8/1987 Hartley ..... B67D 1/107 222/129.2
4,736,873 A * 4/1988 Patriquin ..... B67D 1/104 137/625.6
4,761,118 A * 8/1988 Zanarini ..... F04B 9/1095 417/254
4,779,761 A * 10/1988 Rudick ..... B67D 1/0027 222/1
4,839,107 A * 6/1989 Rudick ..... B01F 3/04808 261/82
4,889,662 A * 12/1989 Smith ..... B01F 3/04815 261/35
4,927,567 A * 5/1990 Rudick ..... B01F 3/04269 261/104
5,505,593 A * 4/1996 Hartley ..... F01B 11/004 417/393
5,545,016 A * 8/1996 Wang ..... F04B 9/135 417/393
5,651,389 A * 7/1997 Anderson ..... F01L 25/063 137/565.11
5,664,940 A * 9/1997 Du ..... F04B 43/0736 417/393
6,017,200 A * 1/2000 Childs ..... B01D 61/06 417/390
6,231,322 B1 * 5/2001 Adolfsson ..... B67D 1/004 261/35
6,435,843 B1 * 8/2002 Hur ..... F04B 9/113 417/393
6,568,911 B1 * 5/2003 Brightwell ..... F04B 9/109 417/243
6,619,336 B2 * 9/2003 Cohen ..... F17C 5/06 141/18
7,082,750 B2 * 8/2006 Knight ..... F02K 9/50 417/393
7,175,395 B1 * 2/2007 Forest ..... F04B 9/115 417/225
7,194,853 B1 * 3/2007 Knight ..... F02K 9/46 417/137
8,162,294 B2 * 4/2012 Scott ..... B01F 3/04808 261/49
9,429,146 B2 * 8/2016 Fong ..... F04B 1/02
2003/0198560 A1 * 10/2003 Able ..... F04B 9/125 417/393
2005/0084395 A1 * 4/2005 Kang ..... A61M 3/0254 417/392
2010/0158717 A1 * 6/2010 Vogt ..... F04B 25/02 417/401
2010/0172771 A1 * 7/2010 Hoffarth ..... F04B 5/02 417/393
2015/0004035 A1 * 1/2015 Bagagli ..... F04B 7/0069 417/510
2016/0153445 A1 * 6/2016 Jiang ..... F04B 53/10 417/53

* cited by examiner

GAS OPERATED BOOSTER PUMP

TECHNICAL FIELD

The present invention relates to a subsidiary apparatus of oil and gas exploitation engineering, and more particularly to an isentropic booster and the method thereof.

BACKGROUND ART

In the field of natural gas gathering and transportation engineering, it is well known that some gas sources may have a pressure lower than the pressure of gas pipeline network, which causes the gas thereof fail to enter the gas pipeline network, whilst the pressure of other gas sources in the same area is higher than the pressure of gas pipeline network. For a long time, people have been involved in development of techniques which use residual pressure of high-pressure gas sources to boost pressure of the low-pressure gas, so that the pressure of the high-pressure gas source and the low-pressure gas source can achieve the pressure of the gas pipeline network simultaneously and enter the gas pipeline network. A commonly used technique is high-pressure gas injection. However, this technique has a very low efficiency of utilization of high-pressure gas pressure. Several times or even dozens of times of the high-pressure gas will be necessary to inject a part of low-pressure gas.

SUMMARY OF THE INVENTION

An object of the present invention is to provide an isentropic booster with more efficient use of high-pressure gas.

According to an aspect of the invention, an isentropic booster is provided which comprises a main body pump having a work chamber being separated into a plurality of independent booster chambers by a fixed division plate, a left piston, a right piston and a connecting rod provided therein. The connecting rod passes through the division plate and connects at its two opposite ends with the left piston and the right piston respectively. The volume of the booster chambers is variable with the movement of the left piston and the right piston. A part of the plurality of the booster chambers connect between high-pressure gas source and a medium-pressure gas pipeline network, and the rest of the plurality of the booster chambers connect between low-pressure gas source and the medium-pressure gas pipeline network.

According to another aspect of the invention, an isentropic booster is provided which comprises a main body pump and first to fourth three-way valves. The main body pump has a work chamber inside. The work chamber is provided with a division plate, a left piston located on the left to the division plate, a right piston located on the right to the division plate, and a connecting rod passing through the division plate and being connected at the left end thereof with the left piston and at the right end thereof with the right piston, first to fourth booster chamber being formed in sequence from left to right by separating the work chamber with the division plate, the left piston and the right piston. The main body pump is provided with first to fourth air inlets and first to fourth air outlets, the first air inlet and the first air outlet communicating with the first booster chamber, the second air inlet and the second air outlet communicating with the fourth booster chamber, the third air inlet and the third air outlet communicating with the second booster chamber, and the fourth air inlet and the fourth air outlet communicating with the third booster chamber. A first port of the first three-way valve communicates with high-pressure gas source, a second and a third ports of the first three-way valve each communicates with the first and the second air inlets; a first port of the second three-way valve communicates with the medium-pressure gas pipeline network, a second port and a third port of the second three-way valve each communicates with the first air outlet and the second air outlet; a first port of the third three-way valve communicates with the low pressure gas source, a second and a third ports of the third three-way valve each communicates with the third and the fourth air inlets; a first port of the fourth three-way valve communicates with the medium-pressure gas pipeline network, and a second and a third ports of the fourth three-way valve each communicates with the third and fourth air outlets.

According to a further aspect of the invention, a method of boosting is provided which comprises connecting a high-pressure gas source and a low-pressure gas source to a medium-pressure gas pipeline network through a main body pump. The main body pump comprises a work chamber being separated into a plurality of independent booster chambers by a fixed division plate, a left piston, a right piston and a connecting rod provided therein. The connecting rod passes through the division plate and connects at its two opposite ends with the left piston and the right piston. The volume of the booster chambers is variable according to the movement of the left piston and the right piston. The method further comprises that, in a cycle of operation of the main body pump, the high-pressure gas source and the low-pressure gas source communicate with the medium-pressure gas pipeline network respectively via the independent booster chambers of the main body pump.

According to the above arrangements, in one cycle, the gas of high-pressure well enters the first booster chamber through the first air inlet via the first three-way valve, the gas of low pressure well enters the third booster chamber through the fourth air inlet via the third three-way valve. With both high-pressure and low-pressure gas, the left and right of the pistons and the connecting rod move to the right, pressing the gas of the second and fourth booster chambers into the medium-pressure gas pipeline network. The gas of the fourth booster chamber is high-pressure gas injected in the previous cycle, and the gas of the second booster chamber is low-pressure gas injected in the previous cycle. At this time, the pressure of the gas of second and fourth booster chambers equals to the pressure of the medium-pressure gas pipe network as the second and the fourth booster chambers communicate with the medium-pressure gas pipeline network, which ultimately realizes a higher efficiency of use of high-pressure gas source.

DESCRIPTION OF EMBODIMENT(S) OF THE INVENTION

Some embodiments of the present invention will be described in detail in the following with reference to the drawings. It should be noted that the following description is for the purpose of illustration of the invention only but are not intended to limit the scope of the invention.

Figure 1:
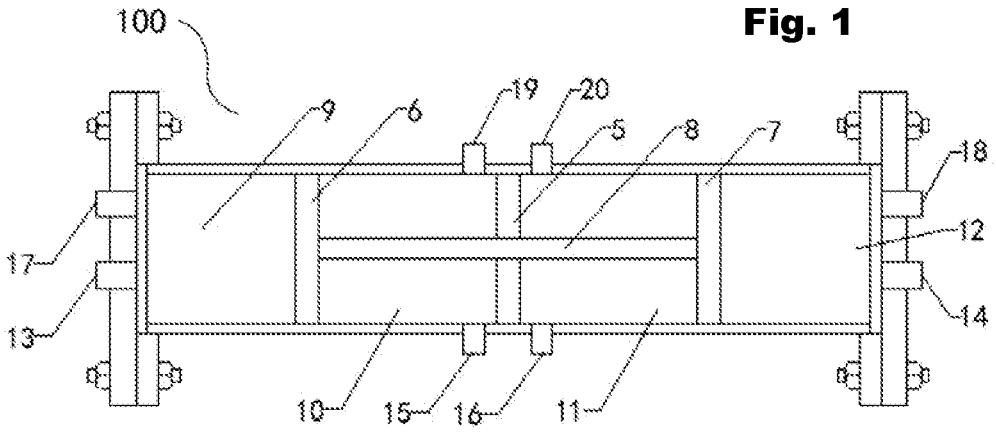
FIG. 1 is a schematic view of the main body pump of an isentropic booster according to an embodiment of the present invention.
Figure 2:
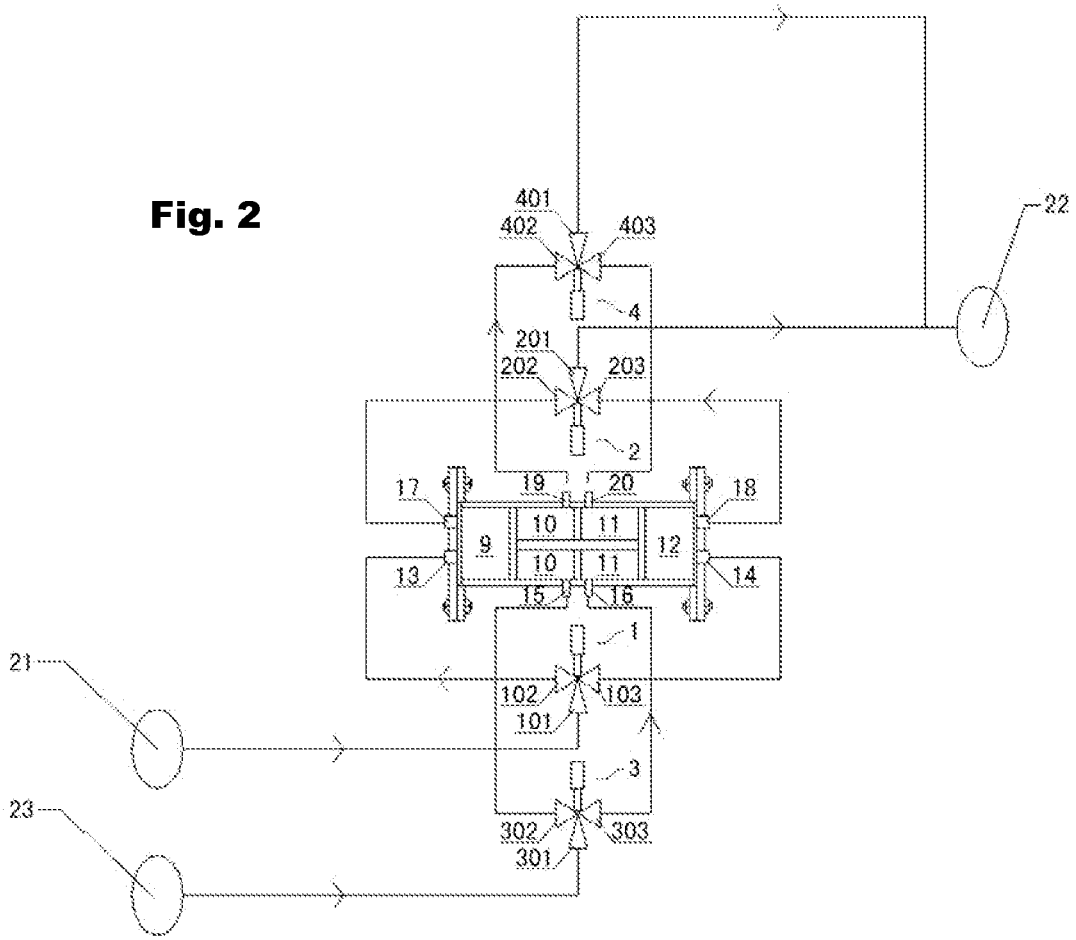
FIG. 2 is a schematic view of an isentropic booster according to an embodiment of the present invention.

As shown in FIGS. 1 and 2, an isentropic booster according to an embodiment of the present invention comprises a main body pump 100 having a work chamber therein, a first three-way valve 1, a second three-way valve 2, a third three-way valve 3 and a fourth three-way valve 4. The work chamber is provided therein with a fixed division plate 5, a left piston 6 located on the left of the division plate, a right piston 7 located on the right of the division plate, and a connecting rod 8 which passes through the division plate 5 and connects at its two opposite ends with the left piston 6 and the right piston 7 respectively. The division plate 5, left piston 6 and right piston 7 separate the work chamber of main body pump 100 into first to fourth booster chamber 9~12 positioned from left to right and not communicated with each other.

The main body pump 100 is provided with a plurality of inlets and outlets. First air inlet 13 and first air outlet 17 communicate with the first booster chamber, second air inlet 14 and second air outlet 18 communicate with the fourth booster chamber 12, third air inlet 15 and third air outlet 19 communicate with the second booster chamber 10, and fourth air inlet 16 and fourth air outlet 20 communicate with the third booster chamber 11.

Referring to FIG. 2, a first port 101 of the first three-way valve 1 connects with a high-pressure gas source 21, a second port 102 and a third port 103 of the first three-way valve 1 respectively connect with the first air inlet 13 and the second air inlet 14. A first port 201 of the second three-way valve 2 connects with a medium-pressure gas pipeline network 22, a second port 202 and a third port 203 of the second three-way valve 3 respectively connect with the first air outlet 17 and the second air outlet 18. A first port 301 of the third three-way valve 3 connects with a low pressure gas source 23, a second port 302 and a third port 303 of the third three-way valve 3 respectively connect with the third air inlet 15 and the fourth air inlet 16. A first port 401 of the fourth three-way valve 4 connects with the medium-pressure gas pipeline network 22, a second port 402 and a third port 403 of the fourth three-way valve 4 respectively connect with the third air outlet 19 and fourth air outlet 20. The first to the fourth three-way valves 1~4 are controlled by a conventional programmable controller (not shown) respectively.

With the above arrangement, in one cycle of boosting operation, the first three-way valve 1 opens so that the first port 101 and the second port 102 communicate with each other and gas from high-pressure well 21 enters the first air inlet 13. Meanwhile, the third three-way valve 3 opens so that the first port 301 and the third port 303 communicate with each other and gas from low-pressure well 23 enters the fourth air inlet 16. Thus, gas from high-pressure well 21 enters the first booster chamber 9 through the first air inlet 13 via the first three-way valve 1, and pushes the connecting rod 8 and the right piston 7 to move towards the right. At this time, the volume of the second booster chamber 10 is reduced, whilst the volume of the third booster chamber 11 is increased, so that the gas of the low-pressure gas source 23 enters into the third booster chamber 11 through the fourth air inlet 16 via the third three-way valve 3. With the combined action of both high-pressure and low-pressure gas, the left piston 6, the right piston 7 and the connecting rod 8 move towards the right, and press the gas of the second booster chamber 10 and the fourth booster chamber 12 into medium-pressure gas pipeline network 22 via the fourth three-way valve 4 through the third air outlet 19 and the second air outlet 18 respectively. When the right piston 7 reaches the right end of the work chamber, the cycle finishes.

In the next cycle, the first three-way valve 1 opens so that the first port 101 and the third port 103 communicate with each other and gas from high-pressure well 21 enters the second air inlet 14. Meanwhile, the third three-way valve 3 opens so that the first port 301 and the second port 302 communicate with each other and gas from low-pressure well 23 enters the third air inlet 15. Thus, low-pressure gas enters the second booster chamber 10, and the high-pressure gas enters the fourth booster chamber 12. The pressure of the first booster chamber 9 and the third booster chamber 11 equal to the pressure of the medium-pressure gas pipe network due to the communication of the first booster chamber 9 and the third booster chamber 11 with the medium-pressure gas pipeline network, which ultimately improves the effect of better use of high-pressure gas. In this way, a bidirectional boosting is realized through the bidirectional movement of the connecting rod 8.

The above descriptions are only embodiments of the present invention. It should be noted that those of ordinary skill in the art can make various improvements and variants without departing from the concept, spirit and scope of the present invention, all such improvements and variants are intended to be within the scope of the present invention.

What is claimed is:

1. A booster, comprising: a main body pump having a work chamber, wherein the work chamber is provided therein with a fixed division plate, a left piston, a right piston, and a connecting rod which separates the work chamber into a plurality of independent booster chambers, the connecting rod passing through the division plate and connecting at its two opposite ends with the left piston and the right piston respectively, a volume of the booster chambers being variable with the movement of the left piston and the right piston, and wherein a part of the plurality of the booster chambers connect between a high-pressure gas source and a medium-pressure gas pipeline network, and the rest of the plurality of the booster chambers connect between a low-pressure gas source and the medium-pressure gas pipeline network, and wherein the plurality of independent booster chambers includes a first, a second, a third, and a fourth booster chamber, the first booster chamber and the fourth booster chamber, located at opposite ends of the work chamber, connect between the high-pressure gas source and the medium-pressure gas pipeline network, and the second booster chamber and the third booster chamber, located between the first and fourth booster chambers, connect with the low-pressure gas source and the medium-pressure gas pipeline network.

2. The booster as claimed in claim 1, wherein the first booster chamber and the fourth booster chamber each connects between the high-pressure gas source and the medium-pressure gas pipeline network through a three-way valve, and the second booster chamber and the third booster chamber each connects between the low-pressure gas source and the medium-pressure gas pipeline network through a three-way valve.

3. The booster as claimed in claim 2, wherein the first booster chamber and the fourth booster chamber each communicates with the high-pressure gas source through a first three-way valve and communicates with the medium-pressure gas pipeline network through a second three-way valve, the second booster chamber and the third booster chamber each communicates with the low-pressure gas source through a third three-way valve and communicates with the medium-pressure gas pipeline network through a fourth three-way valve.

4. The booster according to claim 3, wherein in a first cycle of boosting operation, the first booster chamber communicates with the high-pressure gas source through the first three-way valve, the fourth booster chamber communicates with the medium-pressure gas pipeline network through the second three-way valve, the third booster chamber communicates with the low-pressure gas source through the third three-way valve, and the second booster chamber communicates with the low-pressure gas source through the fourth three-way valve; and in a second cycle of the boosting operation of the booster, the fourth booster chamber communicates with the high-pressure gas source through the first three-way valve, the first booster chamber communicates with the medium-pressure gas pipeline network through the second three-way valve, the second booster chamber communicates with the low-pressure gas source through the third three-way valve, and the third booster chamber communicates with the low-pressure gas source through the fourth three-way valve.

5. A booster comprising a main body pump having a work chamber therein and first, second, third, and fourth three-way valves, wherein the work chamber is provided with a division plate, a left piston located left of the division plate, a right piston located right of the division plate, and a connecting rod passing through the division plate and being connected at a left end thereof with the left piston and at a right end thereof with the right piston, a first booster chamber, a second booster chamber, a third booster chamber, and a fourth booster chamber being formed in sequence from left to right by separating the work chamber with the division plate, the left piston and the right piston, wherein the main body pump is provided with first to fourth air inlets and first to fourth air outlets, the first air inlet and the first air outlet communicating with the first booster chamber, the second air inlet and the second air outlet communicating with the fourth booster chamber, the third air inlet and the third air outlet communicating with the second booster chamber, and the fourth air inlet and the fourth air outlet communicating with the third booster chamber, and wherein a first port of the first three-way valve communicates with a high-pressure gas source, a second and a third ports of the first three-way valve each communicates with the first and the second air inlets; a first port of the second three-way valve communicates with a medium-pressure gas pipeline network, a second and a third port of the second three-way valve each communicates with the first air outlet and the second air outlet; a first port of the third three-way valve communicates with a low pressure gas source, a second port and a third port of the third three-way valve each communicates with the third and the fourth air inlets; a first port of the fourth three-way valve communicates with the medium-pressure gas pipeline network, and a second and a third ports of the fourth three-way valve each communicates with the third and fourth air outlets.

6. A method of boosting comprising:

connecting a high-pressure gas source and a low-pressure gas source to a medium-pressure gas pipeline network via a main body pump having a work chamber provided with a fixed division plate, a left piston, a right piston, and a connecting rod which separate the work chamber into a plurality of mutually independent booster chambers, the connecting rod passing through the division plate and connecting at its two opposite ends with the left piston and the right piston, a volume of the plurality of mutually independent booster chambers being variable according to movement of the left piston and the right piston, wherein in a cycle of boosting operation of the main body pump, the high-pressure gas source and the low-pressure gas source communicate with the medium-pressure gas pipeline network via the plurality of mutually independent booster chambers of the main body pump.

7. The method of claim 6, wherein the plurality of mutually independent booster chambers of the main body pump communicate with the high-pressure gas source, the low-pressure gas source, and the medium-pressure gas pipeline network through a three-way valve, respectively.

8. The method of claim 6, wherein the plurality of mutually independent booster chambers includes a first, a second, a third, and a fourth booster chamber, the first booster chamber and the fourth booster chamber located at the two opposite ends of the work chamber communicate with the high-pressure gas source and the medium-pressure gas pipeline network, and the second booster chamber and the third booster chamber, located between the first and fourth booster chambers, communicate with the low-pressure gas source and the medium-pressure gas pipeline network, and wherein the method further comprises:

in a first cycle of boosting operation of the main body pump, making the first booster chamber communicate with the high-pressure gas source and the third booster chamber communicate with the low-pressure gas source, and making the second booster chamber and the fourth booster chamber communicate with the medium-pressure gas pipeline network; and in a second cycle of the operation of the main body pump, making the fourth booster chamber communicate with the high-pressure gas source and the second booster chamber communicate with the low-pressure gas source, and making the first booster chamber and the third booster chamber communicate with the medium-pressure gas pipeline network.

9. The method of claim 8, wherein the first booster chamber and the fourth booster chamber each communicates with the high-pressure gas source through a first three-way valve, and communicates with the medium-pressure gas pipeline network through a second three-way valve; and wherein the second booster chamber and the third booster chamber each communicates with the low-pressure gas source through a third three-way valve, and communicates with the medium-pressure gas pipeline network through a fourth three-way valve.

* * * * *